US005990424A

United States Patent [19]

Miyazaki

[11] Patent Number: 5,990,424

[45] Date of Patent: Nov. 23, 1999

[54] BREAKER DEVICE

[75] Inventor: Sho Miyazaki, Yokkaichi, Japan

[73] Assignee: Sumitomo Wiring Systems, Ltd., Japan

[21] Appl. No.: 09/211,447

[22] Filed: Dec. 15, 1998

Related U.S. Application Data

[62] Division of application No. 08/988,511, Dec. 10, 1997, Pat. No. 5,911,318.

[51] Int. Cl.[6] ..... H01H 1/54

[52] U.S. Cl. ..... 200/16 R; 200/1 R; 200/17 R; 200/561

[58] Field of Search ..... 200/1 R, 6 R, 200/16 R–16 D, 17 R, 537, 6 B–6 C, 547–550, 553, 554, 557, 248, 561–563, 572, 258, 243, 252, 329, 332, 335

[56] References Cited

U.S. PATENT DOCUMENTS

| | | | |
|---|---|---|---|
| 1,864,548 | 6/1932 | Nordhem | 200/325 |
| 2,198,469 | 4/1940 | Woodward | 200/337 |
| 2,324,876 | 7/1943 | Quentin | 74/565 |
| 2,734,374 | 2/1956 | Crabbs | 70/201 |
| 2,806,099 | 9/1957 | Rexroad | 200/50.05 |
| 2,967,919 | 1/1961 | Greaves | 200/106 |
| 3,187,120 | 6/1965 | Akst | 200/16 A |
| 3,246,101 | 4/1966 | Caputo | 200/104 |
| 4,029,914 | 6/1977 | Schmidt et al. | 200/1 R |
| 4,410,775 | 10/1983 | Howard | 200/52 R |
| 4,822,961 | 4/1989 | Hugin et al. | 200/16 R |
| 5,416,286 | 5/1995 | Dixon, Jr. | 200/16 E |
| 5,708,239 | 1/1998 | Konda et al. | 200/1 R |

FOREIGN PATENT DOCUMENTS

| | | | |
|---|---|---|---|
| 8-293347 | 11/1996 | Japan | H01R 13/52 |
| 8-306265 | 11/1996 | Japan | H01H 21/02 |

*Primary Examiner*—Michael Friedhofer
*Attorney, Agent, or Firm*—Anthony J. Casella; Gerald E. Hespos

[57] ABSTRACT

A breaker device is provided in which a lever can be locked in specified positions with an improved reliability and unlocking can be easily effected. A slider (60) carried by a lever (30) and a panel (22) of a casing (20) define a locking mechanism of the device. When the lever (30) is in a specified rotation position, the slider (60) and the panel (22) are engaged with each other to lock the lever (30) in that position. An unlock portion (62) for unlocking the locking mechanism is provided in a position to be covered by a handle portion (32) of the lever (30). Since this unlock portion (62) is protected by the handle portion (32), a tool or the like cannot come into contact with or strike the unlock portion (62). On the other hand, if a finger is placed on the handle portion (32) to rotate the lever (30), the tip of this finger is located at the underside of the handle portion (32), so that the unlock portion (62) can be easily operated.

8 Claims, 5 Drawing Sheets

BREAKER DEVICE

This application is a divisional of application Ser. No. 08/988,511 filed Dec. 10, 1997, now issued, U.S. Pat. No. 5,911,318.

BACKGROUND OF THE INVENTION

1. Field of the Invention

The present invention relates to a breaker device, in particular to a lever type breaker device.

2. Description of the Prior Art

A prior art lever type breaker device is constructed such that a lever is provided in a casing that has a pair of electrodes. The electrodes are engaged and disengaged by the rotation of the lever. Some prior art breaker devices of this type are provided with a locking mechanism for locking the lever in a specified rotational position. An unlock portion for unlocking the locking mechanism is provided in a position that can be seen by an operator, e.g. on a front surface of casing.

With the above construction, although the operator can easily find the unlock portion, unlocking may be effected inadvertently by a tool or the like striking against the unlock portion during an operation. On the other hand, if the unlock portion is provided in a position where a tool or the like is unlikely to strike it, then performance of an unlocking operation becomes difficult, thereby causing a lower work efficiency.

A switch member for switching the electrical connection of a pair of electrodes is provided in a casing of a known breaker device. A locking mechanism is provided between the switch member and the casing of this prior art device to lock the switch member in an ON state and an OFF state in the same manner to hold the respective states. Thus this known breaker device is capable of holding an operable member for switching the electrical connection of a pair of electrodes in a specified state.

However, as is illustrated next, it is sometime desirable to differ a lock holding force in the ON state and in the OFF state of the breaker device depending upon the use of the breaker device.

For example, in an electric automotive vehicle in which a breaker device for switching a main power source is provided in a trunk, the lock holding force in the ON state needs to be increased to prevent an erroneous operation caused by the contact of a baggage or the like during the driving. On the other hand, the lock holding force in the OFF state is desired to be lower than the lock holding force in the ON state so as to efficiently conduct a repair and/or inspection.

Further, in breaker devices that are enclosed by a cover to prevent an erroneous operation caused by a baggage or the like, it is preferable to have a smaller lock holding force in the ON state to facilitate unlocking with the cover detached. On the other hand, the lock holding force in the OFF state needs to be larger than the lock holding force in the ON state in order to prevent an erroneous operation caused by the contact of a tool or the like.

In view of the above problem, an object of the present invention is to provide a breaker device in which a lever can be locked in a specified position with an improved reliability and particularly unlocking can be easily effected.

SUMMARY OF THE INVENTION

According to the invention, there is provided a breaker device comprising an operable portion or lever for electrically connecting and disconnecting at least one pair of electrodes. The operable portion is movably, preferably rotatably or pivotably, provided in a casing. A locking mechanism is provided for locking the operable portion in a specified movement or rotation position. An unlock portion also is provided for unlocking the locking mechanism. The unlock portion is provided in the vicinity, preferably at the substantially underside, of a movement or rotation effecting portion of the operable portion, and is operated or operable to move or rotate the operable portion.

According to a preferred embodiment of the invention, there is provided a breaker device comprising a lever for connecting and disconnecting a pair of electrodes which is rotatably provided in a casing, and a locking mechanism for locking the lever in a specified rotation position. An unlock portion for unlocking the locking mechanism is provided at the underside of a rotation effecting portion of the lever and is operated to rotate the lever.

Accordingly, since the lever in the specified rotation position is locked by the locking mechanism, it cannot be rotated unless the unlock portion is operated.

The unlock portion is located at the underside of the rotation effecting portion and is protected thereby, i.e. normally is concealed by the rotation effecting portion. Accordingly, even if something strikes the breaker device, the unlock portion is left intact. Thus, there is no likelihood that the locking mechanism is unlocked. On the other hand, in the case that the operator tries to rotate the lever of the breaker device, if he places his finger on the rotation effecting portion from front of the breaker device, the tip of this finger can easily reach the underside of the rotation effecting portion. Therefore, the locking mechanism can be unlocked easily.

Preferably, the operable portion comprises at least one arm portion extending in a direction at an angle different from 0° or 180°, preferably substantially perpendicular, to an axis of rotation of the operable portion. The rotation effecting portion preferably is formed to extend transversely from the leading end of the arm portion. The unlock portion is provided in a position where a finger is placed or placeable on the rotation effecting portion so as to be displaceable in a finger placing or displacing direction.

Further preferably, the lever comprises an arm portion extending in a direction perpendicular to an axis of rotation of the lever. The rotation effecting portion is formed to extend transversely from the leading end of the arm portion, and the unlock portion is provided in a position where a finger is placed on the rotation effecting portion so as to be displaceable in a finger placing direction.

Accordingly, since the unlock portion is displaceable in the finger placing direction, the locking mechanism can be unlocked if the operator places his finger on the rotation effecting portion and presses the unlock portion by this finger. Accordingly, operations can be performed continuously until the locking mechanism is unlocked after the finger is placed on the lever, thereby improving work efficiency.

Further preferably, the pair of electrodes are accommodated in the casing having a substantially closed front surface. The movement or rotation effecting portion of the operable member or lever is displaceable along a panel surface of the casing, and a dented portion or dentation is formed in the panel surface of the casing in a position corresponding to a trace or movement or displacement track or path of the movement or rotation effecting portion.

Accordingly, since the movement or rotation effecting portion of the operable member or lever is so provided as to be displaceable along the panel surface of the casing, the underside of the rotation effecting portion, i.e. the side thereof where the unlock portion is provided faces the panel surface. The finger tip approaches the panel surface before it reaches the underside of the rotation effecting portion. However, since the panel surface is distanced from the underside of the rotation effecting portion by the dented portion formed in the position of the panel surface corresponding to the trace of the rotation effecting portion, the finger and the casing are unlikely to interfere with each other in any rotation position of the lever. Accordingly, the finger easily can reach the unlock portion at the underside of the rotation effecting portion.

Still further preferably, the locking mechanism comprises a lock bar which is engageable with the housing for locking the operable portion and is directly and/or indirectly actionable by the unlock portion so as to be brought out of engagement with the housing, thus allowing for a movement of the operable portion.

Still further preferably, the housing comprises locking portions that are engageable or interacting with the locking mechanism for locking the operable portion.

Most preferably the breaker device further comprises biasing means for biasing the unlock portion toward a position, in which the operable portion is locked against movement.

According to the invention, there is further provided a breaker device which comprises an operable portion for switching the breaker device between an ON state where at least one pair of electrodes are electrically connected and an OFF state where the pair of electrodes are electrically disconnected. An ON engaging portion is provided for holding the operable portion in the ON state by its engagement with an engaging means, and an OFF engaging portion is provided for holding the operable portion in the OFF state by its engagement with the engaging means. A holding force of the ON engaging portion and that of the OFF engaging portion with the engaging means are differed.

Accordingly, there is provided a breaker device in which one of two performances of an operable portion: a lock reliability and an unlock operability which is required more in each of ON and OFF states is enhanced.

Thus, the reliability and operability of the breaker device as a whole can be improved by enhancing one of the two performances of the operable portion, lock reliability and unlock operability, which is required more in each of the ON and OFF states.

According to a preferred embodiment, there is provided a breaker device comprising an operable portion for switching the breaker device between an ON state where a pair of electrodes are electrically connected and an OFF state where the pair of electrodes are electrically disconnected. An ON engaging portion is provided for holding the operable portion in the ON state, and an OFF engaging portion is provided for holding the operable portion in the OFF state by its engagement. A holding force of the ON engaging portion and that of the OFF engaging portion are differed.

Accordingly, the ON engaging portion and the OFF engaging portion need to be disengaged according to the respective holding forces thereof. Thus, one of the ON engaging portion and the OFF engaging portion having a higher holding force is difficult to be disengaged and has a higher lock reliability. On the other hand, the other having a lower holding force is easy to be disengaged and has a good operability.

Preferably, the operable portion comprises an unlock portion for effecting the disengagement of the ON engaging portion and that of the OFF engaging portion. One of the ON engaging portion and the OFF engaging portion having a higher holding force is disengaged on the condition that the unlock portion is operated and the other is disengaged without necessitating the operation of the unlock portion.

Accordingly, since the unlock portion needs to be operated to disengage the engaging portion having a higher holding force, this engaging portion has a higher reliability than the one having a lower holding force. Since the engaging portion having a lower holding force can be disengaged without necessitating the operation of the unlock portion, it has a more improved operability than the one having a higher holding force.

Further preferably, the ON engaging portion and/or the OFF engaging portion comprise(s) a recess into which the engaging means is engageable. The engaging means preferably is disengageable from the recess only if the operable portion is moved or rotated in a direction away from the direction in which the operable member is moved to change its state.

Most preferably, the ON engaging portion and/or the OFF engaging portion are provided on or in the housing, preferably as a portion thereof and are engageable with the engaging means having substantially the form of a bar.

According to a further aspect of the invention, there is provided a breaker device comprising an operable portion or lever for electrically connecting and disconnecting at least one pair of fixed electrodes which is movably, preferably rotatably or pivotably, provided in a casing. An insulating coupling member is provided between the substantially opposite surfaces of the fixed electrodes.

Accordingly, since the fixed electrodes are assembled while being properly positioned with respect to each other, the movable electrode fitted thereon can be slid at a low resistance without being forced. Thus, operability can be improved. Further, the fixed electrodes can be partly assembled. This brings about an effect that the entire device can be easily and efficiently assembled.

Accordingly, there is provided a breaker device which has an improved operability and can more easily be assembled, thus avoiding the problems of the prior art residing in the fact that it is difficult to mount the fixed electrodes such that their axes accurately align with each other. If the axes are displaced, resistance increases when the movable electrode is slid, thereby disadvantageously reducing operability. Further, while the fixed electrodes in the prior art are fixed by the bolts, they may turn together with the bolts as the bolts are tightened. Thus, according to the prior art it is necessary to tighten the bolts while holding the fixed electrodes in a narrow space, i.e. the assembling operation is cumbersome.

Preferably, the fixed electrodes are formed at respective distal ends with insertion openings into which mating portions of the insulating or insulative connection or coupling bar or member can be inserted.

Further preferably, the insertion openings and/or the mating portions of the insulating bar or member are bevelled. Accordingly the insertion or fitting of the insulating bar into the corresponding portions of the fixed electrodes is simplified.

Further preferably, the insulating connection bar or member has (preferably substantially in its portion not inserted into the fixed electrodes) an outer diameter being substantially equal to the inner diameter of the movable electrode and/or of the outer diameter of the fixed electrodes. Accordingly, the movable electrode can be slid smoothly along the insulating connecting bar or member. Furthermore, the outer shape of the fixed electrodes and of the insulating connecting bar or member is substantially continuous or smooth.

These and other objects, features and advantages of the present invention will become more apparent upon a reading of the following detailed description and accompanying drawings.

DETAILED DESCRIPTION OF THE PREFERRED EMBODIMENTS

Figure 1:
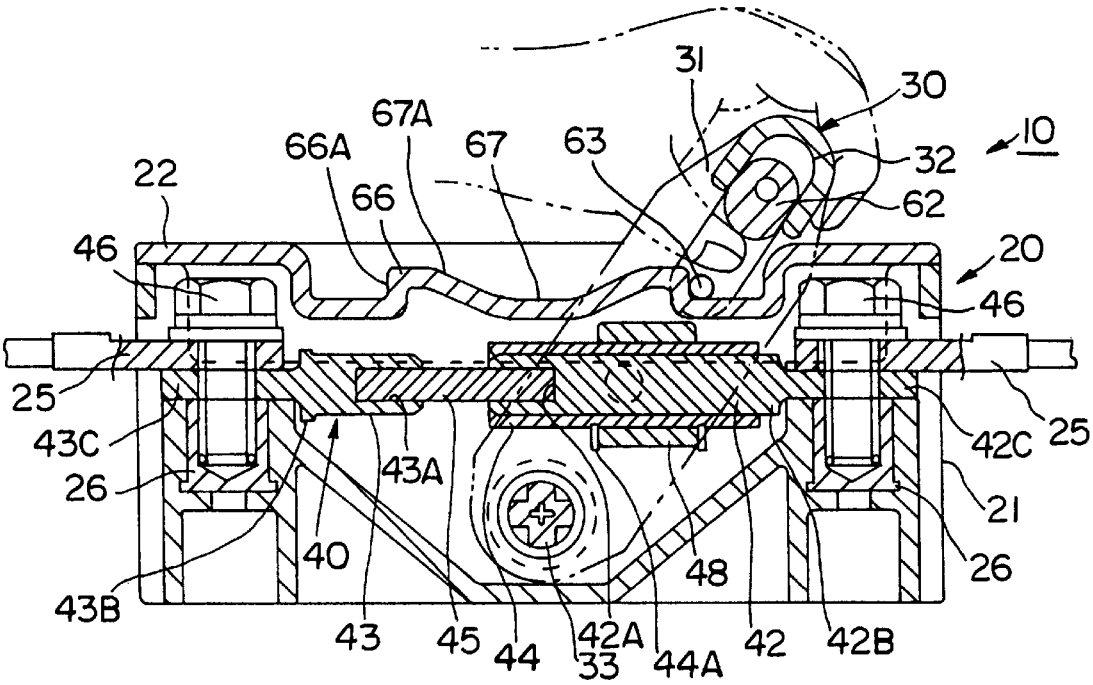
FIG. 1 is a side view in section of a breaker device according to one embodiment of the invention in its OFF state.

Hereafter, one embodiment of a breaker device according to the invention is described with reference to FIGS. 1 to 5. The breaker device 10 according to this embodiment is provided to open and close a main power source circuit for connecting e.g. a battery and a variety of electric equipment in an electric automotive vehicle. An electrode unit 40 accommodated in a casing 20 e.g. of a synthetic resin is connected and disconnected by rotating or pivoting a lever 30.

The casing 20 is comprised of a casing main body 21 preferably in the form of a substantially rectangular parallelepiped having an open upper surface and a panel 22 (see FIG. 1) mountable on the casing main body 21 to substantially close the open upper surface. The casing 20 is secured to a body of the electric automotive vehicle via mount legs 23 (see FIG. 3) provided e.g. at four corners of the casing main body 21, for example, in such a manner that the length of the casing 20 extends along the length of the vehicle body. The inside of the casing main body 21 preferably is divided into three chambers by two partition walls 24 (see FIG. 3), and the electrode unit 40 is arranged in the middle chamber.

The electrode unit 40 is comprised of a pair of fixed electrodes 42, 43 and a movable electrode 44 slidably fittable on the outer surfaces of the fixed electrodes 42, 43. The respective fixed electrodes 42, 43 are preferably in the form of substantially round bars, and one fixed electrode 42 is longer than the other fixed electrode 43. Mount holes 42A, 43A are formed in the centers of the substantially opposite front end surfaces of the fixed electrodes 42, 43. The opposite ends of a nonconductive coupling bar 45 e.g. of a synthetic resin are pressed into the mount holes 42A, 43A, thereby making the fixed electrodes 42, 43 substantially coaxially integral to each other while being spaced and insulated to each other. The fixed electrodes 42, 43 are fastened to nuts 26 formed in the casing main body 21 e.g. by insert molding with bolts, together with connection terminals 25 connected respectively with a battery side cable and an equipment side cable or other electrical or electronic equipment.

The movable electrode 44 has a preferably substantially tubular shape fittable on the fixed electrodes 42, 43, and a louver contact (not shown) is mounted on the inner surface thereof. A coupling member 48 e.g. of a synthetic resin is mounted on the outer surface of the movable electrode 44 by a retaining ring 44A, and is coupled with the lever 30 via coupling shafts 49 (see FIG. 3) projecting from the coupling member 48.

Figure 2:
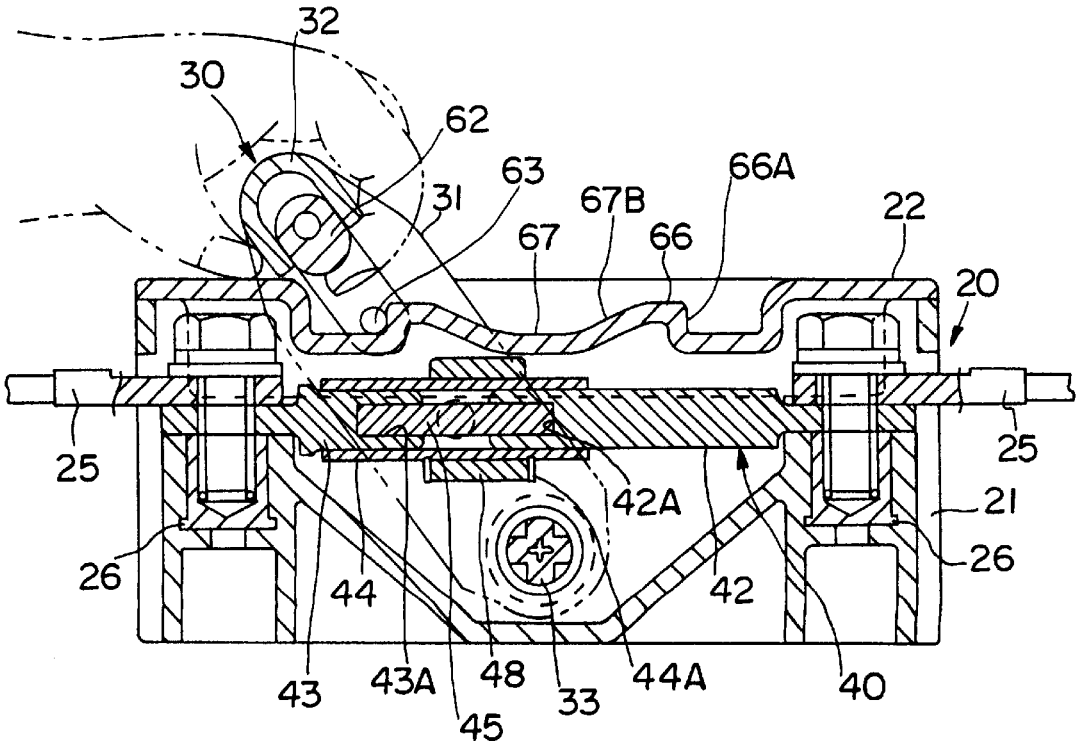
FIG. 2 is a side view in section of the breaker device in its ON state.
Figure 3:
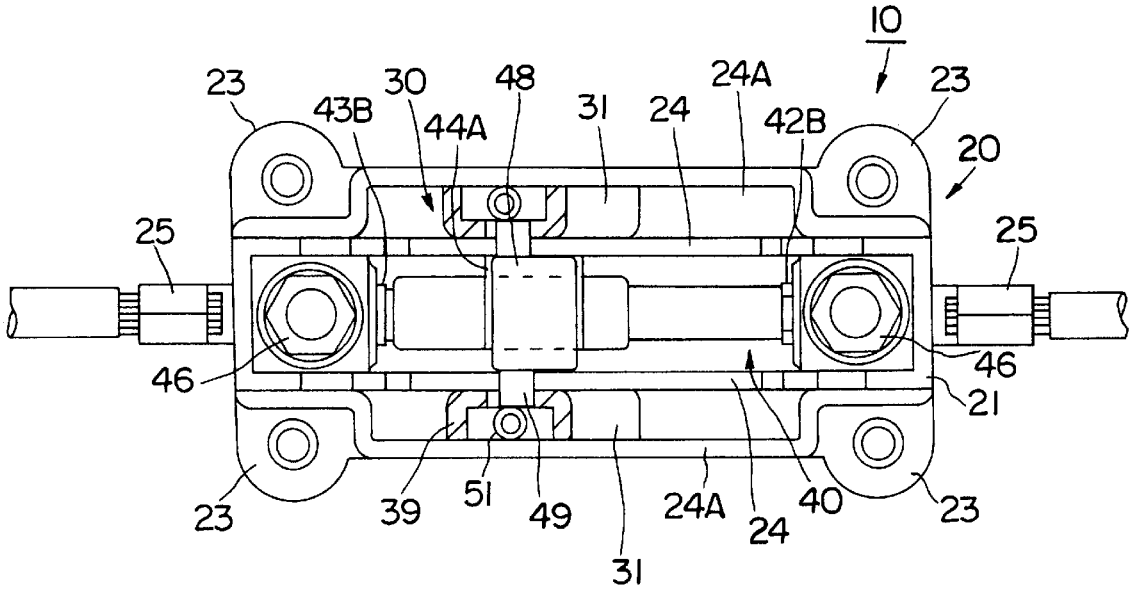
FIG. 3 is a front view in section of the breaker device.
Figure 4:
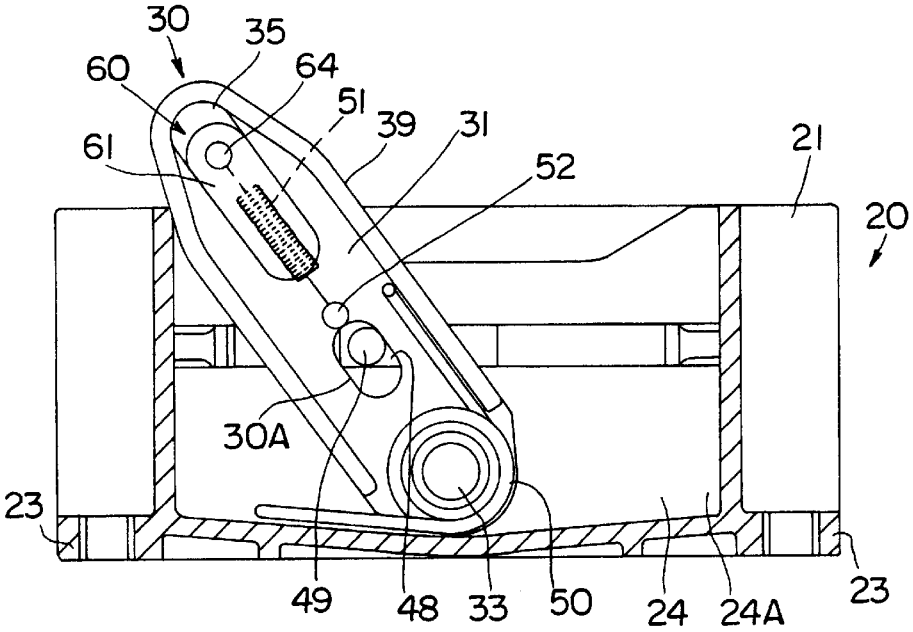
FIG. 4 is a side view in section showing an arm mount space.

The lever 30 is made of a non-conductive material, e.g. a synthetic resin and has a substantially U-shape as a whole in which a handle portion 32 bridges the upper ends of a pair of arms 31. The leading ends of the arms 31 of the lever 30 are inserted into outer spaces 24A (see FIG. 3) on the outside of the partition walls 24 of the casing main body 21 so as to hold the electrode unit 40 substantially therebetween, and the lever 30 is rotatably or pivotably mounted about a rotatable shaft 33 forming an axis of rotation for the lever 30 (see FIG. 1) fixed to the casing main body 21. Oblong holes 30A (see FIG. 4) are formed in intermediate positions of the arms 31, and the coupling shafts 49 of the movable electrode 44 are passed through the oblong holes 30A so that a rotational or pivotal movement of the lever 30 can be translated into a substantially sliding movement of the movable electrode 44. Accordingly, when the lever 30 is in a rotation end position at the right side of FIG. 1, the movable electrode 44 is located on the fixed electrode 42 as shown in FIG. 1 and the fixed electrodes 42, 43 are not electrically connected. When the lever 30 is in another rotation end position at the left side of FIG. 1, the movable electrode 44 extends over the fixed electrodes 42, 43 as shown in FIG. 2 to electrically connect or bridge the fixed electrodes 42, 43. Along the opposite side edges of each arm 31 of the lever 30 is formed a side wall 39 (see FIG. 4) which extends outwardly. One end of a torsion coil spring 50 connected with or arranged substantially around the rotatable shaft 33 engages this side wall 39 to bias the lever 30 toward the position (FIG. 1) where the fixed electrodes 42, 43 are not electrically connected.

Figure 5:
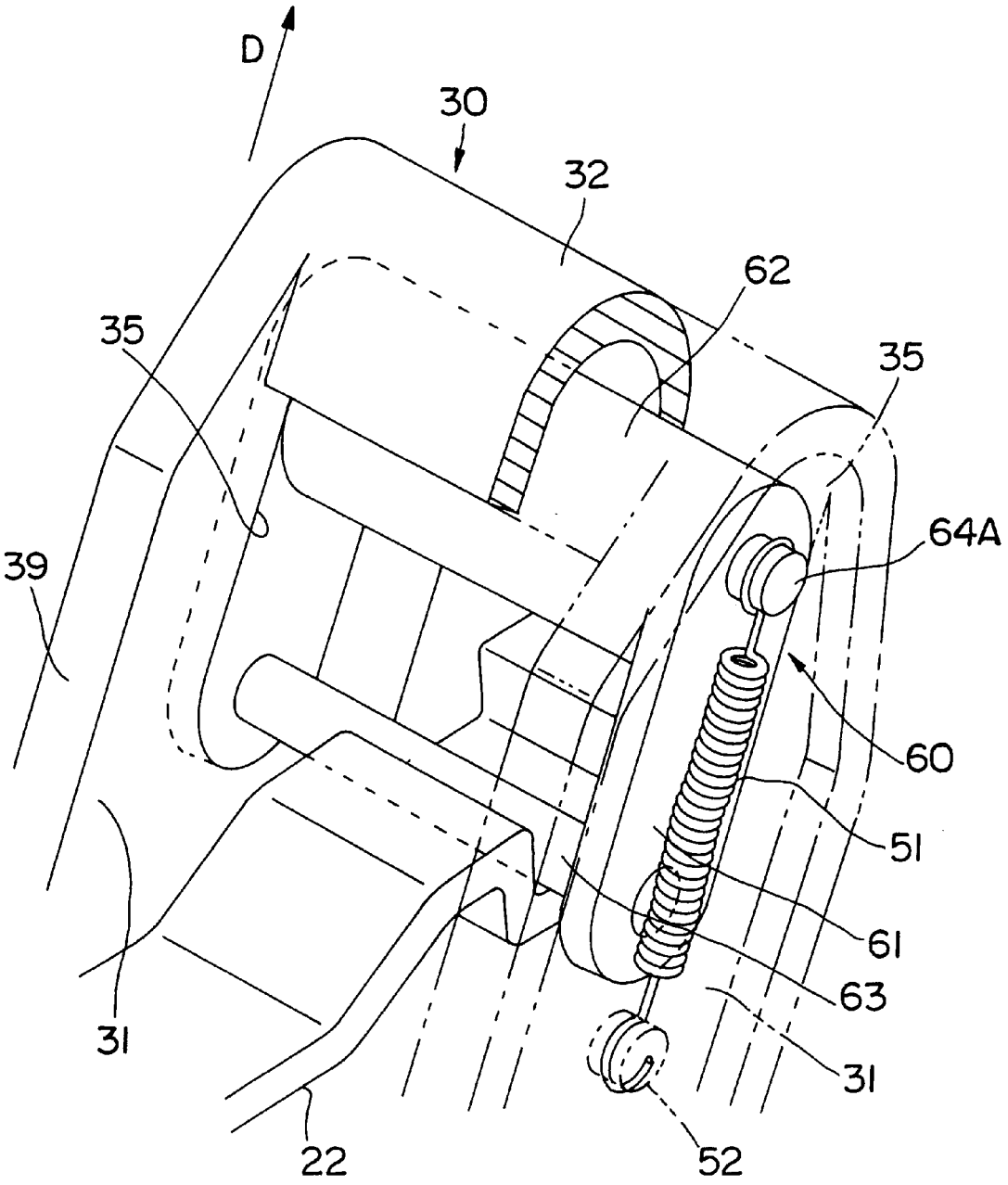
FIG. 5 is a perspective view of an operable portion of a lever.

In each arm 31 of the lever 30 is formed an oblong hole 35 which extends from an intermediate position toward or to the substantially upper end of the arm 31. Further, as shown in FIG. 5, the handle portion 32 has preferably an inversed U-shaped cross section, and the inner surface thereof is substantially continuous with the inner surface of the upper end of each oblong hole 35. In the lever 30, a slider 60 to be described next is slidably supported in the oblong holes 35 in such a manner that it substantially bridges the arms 31.

AS shown in FIG. 5, the slider 60 has preferably a U-shape as a whole in which a transverse member connects the upper ends of a pair of pieces 61 which are slidably movable in the respective oblong holes 35. This transverse member serves as an unlock portion 62. Metal bars are placed in the opposite side portions of the unlock portion 62 to form spring mount portions 64A which project substantially sideways e.g. by insert moling. One end of a tension coil spring 51 is mounted on the corresponding spring mount portion 64A, and the other end thereof is mounted on a spring fixing portion 52 projecting in an intermediate position of the outer surface of the arm 31, thereby fastening the tension coil 51 to the arm 31 and toward the center of rotation of the lever 30 (e.g. the rotatable shaft 33). Further, the slider 60 has its movement to the side restricted by the inner wall of the casing 20 so that the pieces 61 come out of the oblong holes 35 substantially sideways.

The slider 60 also includes a metal lock bar 63 which substantially bridges the bottom ends of the pieces 61. This lock bar 63 is located on the outside of the panel 22 of the casing 20 and is displaced along the panel 22 as the lever 30 is rotated. As shown in FIGS. 1 and 2, the panel 22 is formed with lock portions 66 which are engageable with the lock bar 63 when the lever 30 is located at the left and right rotation end positions, thereby forming a locking mechanism for locking the lever 30 preferably in the left and right rotation end positions. The lock portions 66 are comprised of standing wall portions 66A formed e.g. by denting portions of the panel 22 near the respective ends, and are preferably symmetrically formed along the transverse direction of FIG. 1 to be engageable with the lock bar 63. The lock bar 63 cannot move over the standing wall portion 66A unless the slider 60 is moved, in particular pulled up against a biasing force of the tension coil spring 51. In this manner, the rotation of the lever 30 is restricted. Between the lock portions 66 is formed a dented portion 67 in a position corresponding to the trace of displacement of the lock bar 63. The opposite sides of the dented portion 67 are slanted surfaces 67A which are moderately sloped to be continous with the upper ends of the lock portions 66.

The locking mechanism is unlocked by moving, in particular pulling up the slider 60, specifically by operating the unlock portion 62 in a direction D (FIG. 5) in particular radially away from the rotatable shaft 33. This unlock portion 62 has its upper end covered by the handle portion 32 of the lever 30 as shown in FIGS. 1 and 5, and its lower end normally projects from an open portion of the handle portion 32. The slider 60 is moved by pulling this projected portion upwardly toward the handle portion 32 (in a direction away from the rotatable shaft 33) against the biasing force of the tension coil spring 51, with the result that the locking mechanism is unlocked. The open portion of the handle portion 32 is located in such a position where the tip of a hooked finger of an operator is placed when he operates the lever 30. Accordingly, unlocking can be easily performed.

Next, the action of this embodiment is described.

In order to keep the electric automotive vechile in a state where it can start driving any time, the breaker device 10 is normally locked in its ON state to connect the battery and the various electric equipments. If the vehicle is driven in this state, the vibration of the vehicle may be transmitted to the breaker device 10. If the vehicle is, for example, of the type in which the breaker device 10 is installed in a trunk, a baggage may contact or strike the breaker 10. The locking mechanism cannot be unlocked by the vibration of the vehicle because the lock bar 63 is pressed against the standing wall portion 66A by the biasing force of the coil spring 51. Further, since the unlock portion 62 for unlocking the locking mechanism is located behind the handle portion 32 and is protected thereby against the contact of the baggage or the like, the unlock portion 62 is left intact even if a baggage or the like comes into contact with or strikes the breaker device 10 and, therefore, the locking mechanism cannot be unlocked.

For the repair and inspection of the electric automotive vehicle, the breaker device 10 is turned off to electrically disconnect the various electric equipments to be inspected from the breaker.

In order to bring the breaker device 10 from the ON state (see FIG. 2) to the OFF state (see FIG. 1), the operator faces the breaker device 10 and places a finger (e.g. a forefinger) on the handle portion 32 from front. As shown in FIG. 2, the finger is hooked when being placed and the finger tip can easily reach the underside of the handle portion 32 where the unlock portion 62 is provided. Although the finger tip approaches the panel 22 before reaching the underside of the handle portion 32, the panel 22 does not cause interference since the panel 22 is formed with the dented portion 67 and is distanced from the underside of the handle portion 32. Thus, the finger tip can easily reach the underside of the handle portion 32.

When the finger tip placed on the handle portion 32 is pulled up, the unlock portion 62 is displaced to unlock the locking mechanism. If the operator applies a force in clockwise direction of FIG. 2 in this state, the lever 30 is rotated. By taking the finger off when the lever 30 reaches the rotation end position at the opposite side, the slider 60 is moved downward by the biasing force of the tension coil spring 51 and the lever 30 is located in its OFF state (see FIG. 1).

Even if a tool or the like strikes the breaker device 10 locked in its OFF state during the repair or inspection, the locking mechanism cannot be unlocked as in the case where the baggage strikes it.

In order to bring the breaker device 10 from the OFF state to the ON state after the repair or inspection, it is sufficient to place a finger (e.g. a thumb) on the unlock portion 62 as shown in FIG. 1 to unlock the locking mechanism and to rotate the lever 30 counterclockwise. This is basically similar to the aforementioned operation.

As described above, the breaker device 10 according to this embodiment has an excellent operability because operations can be continuously performed until the locking mechanism is unlocked after the finger is placed on the lever. In addition, since the unlock portion 62 for unlocking the locking mechanism is protected by the handle portion 32, the locking mechanim can be securely kept locked even if a baggage, tool or the like strikes the breaker device 10.

Next a further embodiment will be described with reference to FIGS. 6 to 9, wherein same or similar elements as in the previous embodiment are denoted with same or similar reference numbers and a description thereof will be omitted hereinafter.

Figure 6:
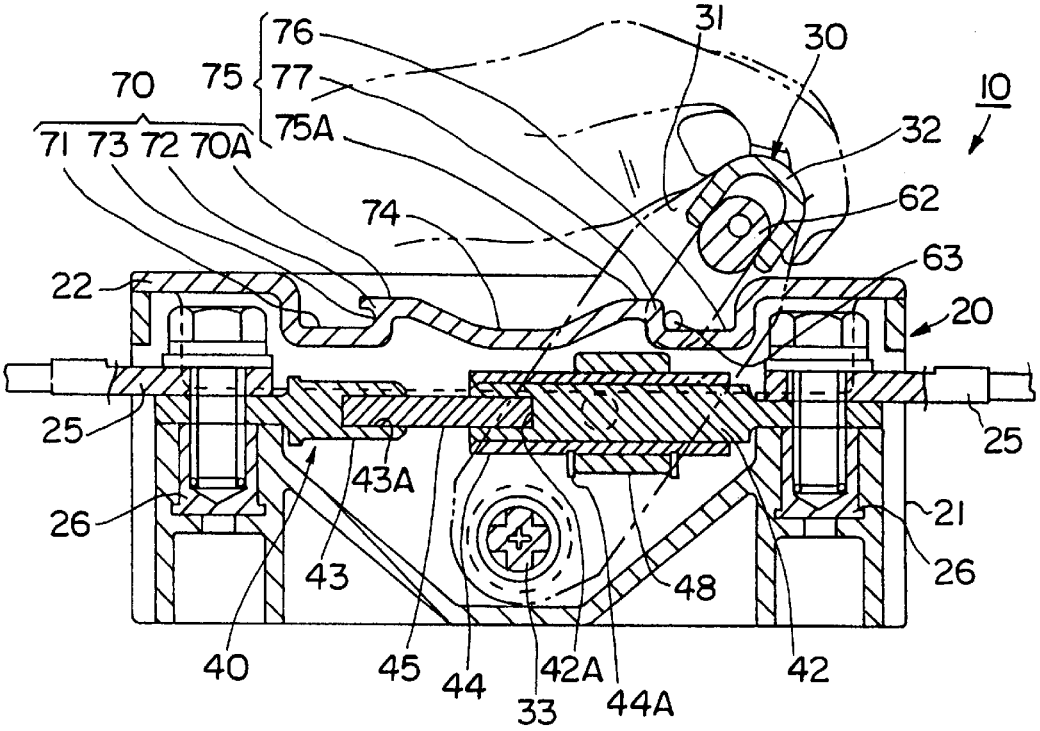
FIG. 6 is a side view in section of a breaker device according to one embodiment of the invention in its OFF state.
Figure 8:
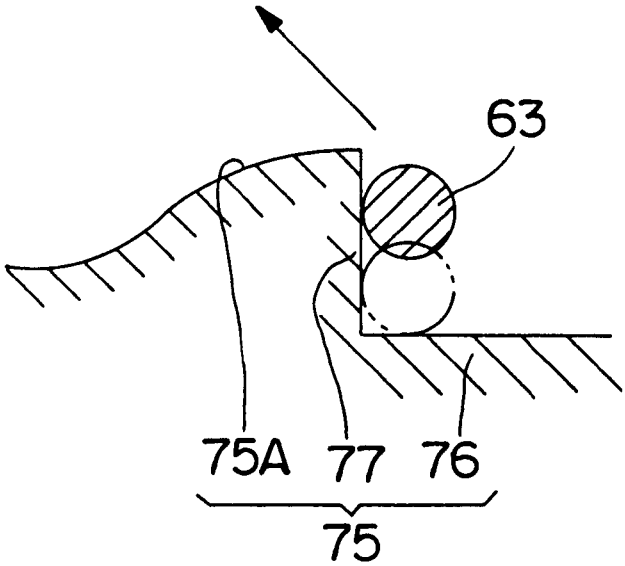
FIG. 8 is an enlarged section of an OFF lock portion.

In this embodiment the panel 22 is formed with an ON lock portion 70 and an OFF lock portion 75 which are engageable with the lock bar 63 when the lever 30 is positioned at the left and right rotation end portions of FIG. 6. The OFF engaging portion 75 correspond to a "OFF engaging portion", together with the lock bar 63, and includes a bottom wall portion 76 and a standing wall portion 77 formed by denting the panel 22 in vicinity of its right end. The lock bar 63 is biased by the tension coil spring 51 and pressed against a corner portion defined between the wall portions 76, 77, thereby locking the lever 30 lest it should freely rotate or pivot. Since the extension of the standing wall portion 77 is not substantially normal to a moving direction (direction of an arrow in FIG. 8) of the lock bar 63 according to the rotation of the lever 30 as shown in FIG. 8 and depending on the height or extension or vertical extension of the wall portion 77, the lock bar 63 moves or may move toward the upper part of the lever 30 against the biasing force of the tension coil spring 51 while being preferably in sliding contact with the wall portion 77. As a result, the lock bar 63 moves over the wall portion 77 and unlocking is effected in the OFF state. This unlocking can also be effected by pulling up the unlock portion 62 to be described later.

Figure 9:
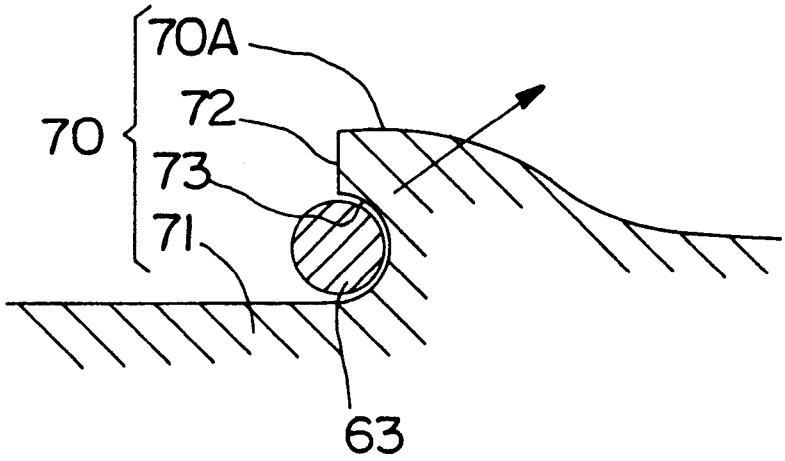
FIG. 9 is an enlarged section of an ON lock portion.

On the other hand, the ON lock portion 70 corresponds to an "ON engaging portion" together with the lock bar 63, and includes a bottom wall portion 71 and a standing wall portion 72 formed by denting the panel 22 in vicinity of its left end. The standing wall portion 72 is formed with a recess 73 having preferably a semicircular cross section so as to conform or correspond to the shape of the lock bar 63. The lock bar 63 is pressed into the recess 73 by being biased by the tension coil spring 51 and the torson coil spring 50, and the lever 30 is held so as not to freely rotate. Further, as shown in FIG. 9, since the recess 73 overhangs lest the lock bar 63 should move toward the upper part of the lever 30, the lock bar 63 cannot move over the standing wall portion 72 even if an attempt is made to rotate the lever 30 with a force larger than the above mentioned level. Accordingly, unlocking cannot be effected in the ON state. In other words, there is a difference between the lock holding force of the ON lock protion 70 and that of the OFF lock portion 75.

The lock bar 63 is disengaged from the ON lock portion 70 by pulling up the slider 60. This operation is performed by the above mentioned unlock portion 62. This unlock portion 62 has its upper end substantially covered by the handle portion 32 of the lever 30 as shown in FIGS. 6 and 5. Normally, a bottom end portion of the unlock portion 62 projects through the opening of the handle portion 32. Unlocking is effected as follows. The lever 30 is slightly rotated or pivoted (e.g. counterclockwise in FIG. 7) to substantially disengage the lock bar 63 from the recess 73 and the unlock portion 62 is moved, in particular pulled up toward the handle portion 32 against the biasing force of the tension coil spring 51, thereby moving the slider 60 toward the upper part of the lever 30. As a result, the lock bar 63 can move over the standing wall portion 72.

Between the lock portions 70 and 75 is formed a dented portion 74 in a position corresponding to a trace of displacement of the lock bar 63. The opposite ends of the dented portion 74 are moderately sloped so as to be continous with flat upper end surfaces 70A, 75A of the lock portions 70, 75.

Next, the action of this embodiment is described.

Figure 7:
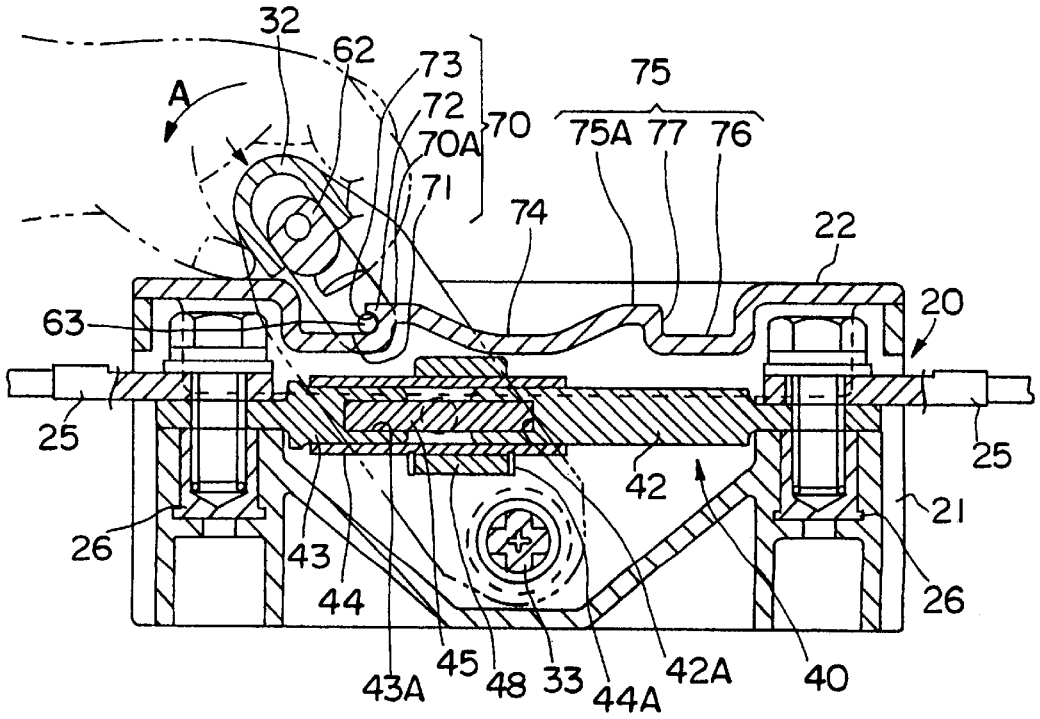
FIG. 7 is a side view in section of the breaker device in its ON state.

First, description is made on a case where the breaker device 10 is on. When the breaker device 10 is on, the lock bar 63 is engaged with the ON lock portion 70 as shown in FIG. 7. More specifically, the lock bar 63 is located in the recess 73 by the biasing forces of the coil springs 50, 51, and the recess 73 overhangs toward the side where the lock bar 63 moves substantially over the standing wall portion 72.

Here, a case e.g. where the breaker device 10 is subjected to vibration or a baggage in a trunk strikes the lever 30 while an electric automotive vehicle is running is considered. There is no likelihood that the lock bar 63 moves upon being subjected to vibration because it is biased by the coil springs 50, 51 so as to be located in the recess 73. Even if a force acts to rotate the lever 30 when a baggage strikes the lever 30, the lock bar 63 is pressed against the recess 73 and cannot move toward the side where it can move over the standing wall portion 72. Thus, the lever 30 cannot be rotated.

The breaker device 10 is intentionally switched on in the following manner. First, an operator faces the breaker device 10 and places his finger on the handle portion 32 from front. The tip of the placed finger is moved to the underside of the handle portion 32, and the unlock portion 62 is pulled up while the lever 30 is pivoted or rotated in a direction A away from or opposed to the direction of rotation toward the OFF position (FIG. 6; e.g. counterclockwise of FIG. 7). Then, the lock bar 63 is disengaged from the recess 73 and moved above the standing wall portion 72. If the lever 30 is rotated clockwise of FIG. 7 in this state, the lock bar 63 substantially moves over the standing wall portion 72. The breaker device 10 is switched off when the lever 30 reaches the rotation end position.

Next, description is given on a case where the breaker device 10 is off. In the OFF state, the lock bar 63 is engaged with the OFF lock portion 75 as shown in FIG. 6.

The breaker device 10 is switched on as follows. A finger is placed on the lever 30 to rotate it counterclockwise of FIG. 6. Then, the lock bar 63 is obliquely pressed against the standing wall portion 77 as indicated by an arrow in FIG. 8. If a force for rotating the lever 30 is larger than the predetermined force, the lock bar 63 moves upward along the standing wall portion 77 and substantially moves over the standing wall portion 77, thereby effecting unlocking. The breaker device 10 is switched on if the lever 30 is further rotated in the same direction.

As described above, this embodiment has an excellent operability since the unlock portion 62 needs not be operated in the ON state different from the OFF state. As a result, the breaker device 10 can be switched on by a single operation of rotating the lever 30 counterclockwise of FIG. 6, thereby improving operability.

Thus, the breaker device 10 according to this embodiment is allowed to have improved reliability and operability by enhancing one of two performances of the lever 30: lock reliability and unlock operability which is required more in each of the ON and OFF states.

Here, a case where a tool or the like inadvertently strikes the lever 30 while the breaker device 10 is off, e.g. during the repair or inspection of the electric automotive vehicle is considered. Unlike a continuously acting force which an operator applies to rotate or pivot the lever 30, a contact of the tool or the like is an instantaneous force. Even upon being subjected to such a force, the lock bar 63 does not move over the standing wall portion 77, and unlocking cannot be effected unless the direction of this force coincides with the direction in which the lever 30 should be rotated. Accordingly, there is no likelihood of unlocking. Therefore, the reliability of the breaker device 10 in the OFF state is also ensured within a necessary range.

Mount holes 42A, 43A are formed substantially in the center of the leading end faces of the fixed electrodes 42, 43 which substantially face each other. An insulating coupling bar 45 made e.g. of a synthetic resin has its opposite ends pressed or inserted or fitted into the mount holes 42A, 43A. Specifically, by pressing the opposite ends of the coupling bar 45 into the respective mount holes 42A, 43A, the fixed electrodes 42, 43 can be integrally assembled while substantially facing each other in an insulated state with spaced apart and being accurately coaxially arranged, i.e. within a predetermined or predeterminable range of accuracy. At the rear ends of the fixed electrodes 42, 43, mount plates 42C, 43C (FIG. 1) each formed with a mount hole are formed via jaw portions 42B, 43B (FIGS. 1 and 3) with which the opposite ends of the movable electrodes 44 come or may come into contact. In other words the jaw portions 42B, 43B are provided on a portion of the respective fixed electrodes 42, 43, which is substantially opposed to the distal ends thereof, on which the mount holes 42A, 43A are formed.

Herebelow, the assembling procedure is described. First, the electrode unit 40 is assembled. The movable electrode 44 on which the coupling member 48 is mounted is fitted on the longer electrode 42 from its leading end and pushed until coming substantially into contact with the jaw portion 42B. Subsequently, one end of the coupling bar 45 is pushed into the mount hole 42A at the leading end of the fixed electrode 42. Finally, the other end of the coupling bar 45 is pushed into the mount hole 43A of the shorter fixed electrode 43. In this way, the fixed electrodes 42, 43 can be integrally assembled while substantially facing each other in an insulated state with spaced apart and being preferably accurately coaxially arranged. Further, the movable electrode 44 is slidable over the both fixed electrodes 42, 43.

As described above, according to this embodiment, the fixed electrodes 42, 43 are assembled while being preferably accurately coaxially positioned with respect to each other via the insulating coupling bar 45. Accordingly, the movable electrode 44 fitted on the fixed electrodes 42, 43 can be slid at a low resistance without being forced, thereby improving operability. Further, by integrally assembling the fixed electrodes 42, 43 in advance, the bolts 46 (FIGS. 1 and 3) can be easily tightened, enabling an efficient assembling operation.

The present invention is not limited to the described and illustrated embodiment, but the following embodiments are also embraced by the technical scope of the present invention as defined in the claims. Further, a variety of other changes can be made without departing from the scope and spirit of the invention as defined in the claims.

The electrode unit 40 comprised of the bar members (fixed electrodes 42, 43) as a pair of contact elements and the tubular member (movable electrode 44) is used in the foregoing embodiment. However, so-called butt terminals of surface contact type or knife switch type terminals may be, for example, used as the pair of contact elements. Butt terminals are usually provided on the sliding door or the rear door of a vehicle where the contact surface of one terminal should be brought into contact with (or abuts against) the contact surface of another terminal in a substantially "face-to-face" manner. In other words, the butt terminals are usually not brought into contact with each other in a usual manner of "male terminal being inserted into female terminal".

Although unlocking is effected by displacing the unlock portion in a finger placing direction in the foregoing embodiment, the unlock portion 62 may be, for example, slid along a direction perpendicular to the finger placing direction to unlock the locking mechanism. Such a construction can more securely prevent an erroneous unlocking caused by the contact of a baggage, tool or the like.

In the foregoing embodiment, one of unlock operability and lock reliability which is required more in each of the ON and OFF states is enhanced depending upon whether or not the unlock portion 62 needs to be operated to effect unlocking. However, the same can be realized without making the operation of the unlock portion 62 a condition by, for example, differing the height of the standing wall portions 72, 77.

Although lock reliability is enhanced in the ON state and unlock operability is enhanced in the OFF state in the foregoing embodiment, a reverse construction may be adopted if necessary.

What is claimed is:

1. A breaker device, comprising:

a casing main body;

first and second bar-shaped fixed electrodes substantially coaxially aligned, each said fixed electrode having a fixed end securely mounted to the casing main body and an opposed free end disposed in opposed spaced relationship to one another;

a tubular movable electrode slidable on said first fixed electrode between a first position where said movable electrode is spaced from said second fixed electrode and a second position where said movable electrode is electrically connected to both said first and second fixed electrodes;

a pair of coaxially aligned coupling shafts projecting transversely from the tubular movable electrode;

a lever pivotally mounted to the casing main body for rotation about an axis spaced from and perpendicular to the coaxially aligned fixed electrodes, the lever comprising a pair of arms disposed on opposite respective sides of the tubular movable electrode, each said arm having an oblong hole loosely engaged around a respective one of the coupling shafts projecting transversely from the tubular movable electrode, such that pivoting movement of the lever about the axis causes portions of the lever arms adjacent the oblong holes to exert forces on the coupling shafts for moving the movable electrode; and an insulating connecting member extending rigidly between the free ends of the first and second fixed electrodes for maintaining the coaxial alignment therebetween despite forces imposed by the lever at angles to the fixed electrodes, the insulating connecting member being cross-sectionally smaller than the first and second fixed electrodes, such that a space exists between said movable electrodes and said insulating connecting member as said movable electrode is moved from said first position into said second position, whereby the coaxial alignment of said first and second fixed electrodes achieved by said insulating connecting member enables efficient sliding movement of said movable electrode into and out of electrical engagement with said second fixed electrode.

2. The breaker device of claim 1, wherein the first and second fixed electrodes are substantially cylindrical.

3. The breaker device of claim 2, wherein the movable electrode is a substantially cylindrical tubular member dimensioned for sliding engagement over said first and second fixed electrodes.

4. The breaker device of claim 2, further comprising a spring extending between the casing main body and the lever for biasing the movable electrode into a selected position relative to said fixed electrodes.

5. The breaker device of claim 1, wherein said first and second fixed electrodes are substantially cylindrical and have substantially equal outside diameters, the free ends of the first and second fixed electrodes having end surfaces in spaced juxtaposed relationship to one another, the end surfaces of said first and second fixed electrodes having axially aligned recesses extending therein, said insulating connecting member extending from the recess of the first fixed electrode to the recess of the second fixed electrode.

6. The breaker device of claim 1, wherein the free end of at least the second fixed electrode is tapered toward the insulating connecting member for facilitating sliding movement of the movable electrode over the second fixed electrode despite any bending of the first fixed electrode created by pivoting movement of the lever.

7. The breaker device of claim 6, wherein the movable electrode has opposed first and second ends, the second end of the movable electrode being slidably engageable over the free end of the second fixed electrode, the second end of the movable electrode being chamfered for facilitating slidable movement of the movable electrode over the free end of the second fixed electrode.

8. The breaker device of claim 1, wherein the movable electrode has opposed first and second ends, the second end of the movable electrode being slidably engageable over the free end of the second fixed electrode, the second end of the movable electrode being chamfered for facilitating slidable movement of the movable electrode over the free end of the second fixed electrode.

* * * * *